US007625024B2

(12) United States Patent
Wright et al.

(10) Patent No.: US 7,625,024 B2
(45) Date of Patent: Dec. 1, 2009

(54) LIFTING LUG FOR TANKS AND THE LIKE

(76) Inventors: Hal Wright, Box 238, Marsden, Saskatchewan (CA) S0M 1P0; Murray MacDonald, 5405 23rd Street, Lloydminister, Alberta (CA) T9V 2V5

( * ) Notice: Subject to any disclaimer, the term of this patent is extended or adjusted under 35 U.S.C. 154(b) by 36 days.

(21) Appl. No.: 11/643,928

(22) Filed: Dec. 22, 2006

(65) Prior Publication Data

US 2008/0150304 A1 Jun. 26, 2008

(51) Int. Cl.
*B66C 1/00* (2006.01)

(52) U.S. Cl. ..... 294/1.1; 294/82.1

(58) Field of Classification Search ..... 294/1.1, 294/82.1, 81.5, 81.6, 81.61, 85, 82.17, 82.19, 294/68.1, 68.3, 82.13, 16, 89; 403/78, 318; 220/1.5

See application file for complete search history.

(56) References Cited

U.S. PATENT DOCUMENTS 1,727,685 A * 9/1929 Willoughby ..... 294/68.1
4,707,011 A * 11/1987 McKim, Jr. ..... 294/31.1
4,733,896 A * 3/1988 Klein ..... 294/68.1
6,039,500 A * 3/2000 Kwon ..... 294/1.1

* cited by examiner

*Primary Examiner*—Paul T Chin
(74) *Attorney, Agent, or Firm*—Nixon & Vanderhye P.C.

(57) ABSTRACT

A lifting lug apparatus comprises a mounting plate adapted for attachment to an upper portion of an object to be lifted. A lifting lug defines a hook aperture and is pivotally attached to the mounting plate such that the hook aperture is movable from a lateral position, wherein the hook aperture is oriented in a lateral plane extending outward from the mounting plate and outward from an attached object to be lifted, to an upright position, wherein the hook aperture is oriented in an upright plane extending upward from the mounting plate. The lifting lug is biased toward the lateral position so that a lifting hook can conveniently be engaged in the hook aperture and when the object is lifted the lifting lug pivots upward to reduce stress on the connection between the lifting lug and the object.

10 Claims, 2 Drawing Sheets

LIFTING LUG FOR TANKS AND THE LIKE

This invention is in the field of lifting and moving large tanks and like objects, and in particular mechanisms for attaching a lifting apparatus to the objects.

BACKGROUND

It is well known to attach a crane or like lifting apparatus to large objects to raise and lower such objects. In the oil industry for example large storage tanks are commonly located at well-sites to store oil bearing fluids pumped from underground reservoirs. Such tanks are typically located inside containment enclosures which comprise raised walls operative to contain the stored fluid in the event that the tank leaks. Thus to move a tank into or out of the containment enclosure, a crane is required to raise the tank and swing in or out as required.

In a typical tank, lifting lugs are provided at locations spaced around the top of the tank each lug providing an aperture for attaching a hook on the end of a cable from the crane. The lugs are typically welded on the top of the tank wall and extend above the top of the tank and define an aperture above the top of the tank. The tanks are quite tall and in addition to requiring a crane when a tank is to he lifted, a separate vehicle with a man-lift is required as well to raise a person to each lug to insert the hook through the aperture in the lug.

SUMMARY OF THE INVENTION

It is an object of the present invention to provide a lifting lug for attachment to a large object to facilitate attachment of a lifting hook that overcomes problems in the prior art.

Prior art lifting lugs are configured such that the aperture is oriented in a substantially vertical plane that substantially coincides with the tank wall, and so a person is required in order to manipulate the lifting hook into the aperture.

The lifting lug of the present invention is pivotally attached to the top of the tank wall and counterweighted such that the aperture is ordinarily oriented in a substantially horizontal plane. A tag line is attached to the hook from the crane cable, and the person remaining on the ground can then manipulate the hook under the horizontal aperture and the hook can be raised and enter the aperture. As the hook is raised further it pulls up on the lug and the lug pivots to a conventional position with the aperture in a vertical plane and lifting proceeds as with the conventional lugs.

If the lug was fixed with the aperture in a horizontal plane extending out from the tank, considerable bending forces would be exerted on the tank wall. By pivoting into the conventional position with the aperture in a vertical plane coincidental with the tank wall the forces on the tank wall are substantially the same as with the conventional fixed lug. In a typical lifting situation with a large object such as a tank a main cable will be positioned above a center of the tank, and a number of secondary cables will extend at an angle from the main cable to lifting lugs spaced around the top of the tank. With the pivoting lug of the present invention, the lug can move past the vertical position and align itself with the angle of the secondary cable, thereby reducing stress on the lug and tank.

Thus a separate man-lift vehicle is not required when moving tanks with the lug of the present invention, significantly reducing the cost of the move.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams arc labeled with like numbers, and where.

DETAILED DESCRIPTION OF THE ILLUSTRATED EMBODIMENTS

Figure 1:
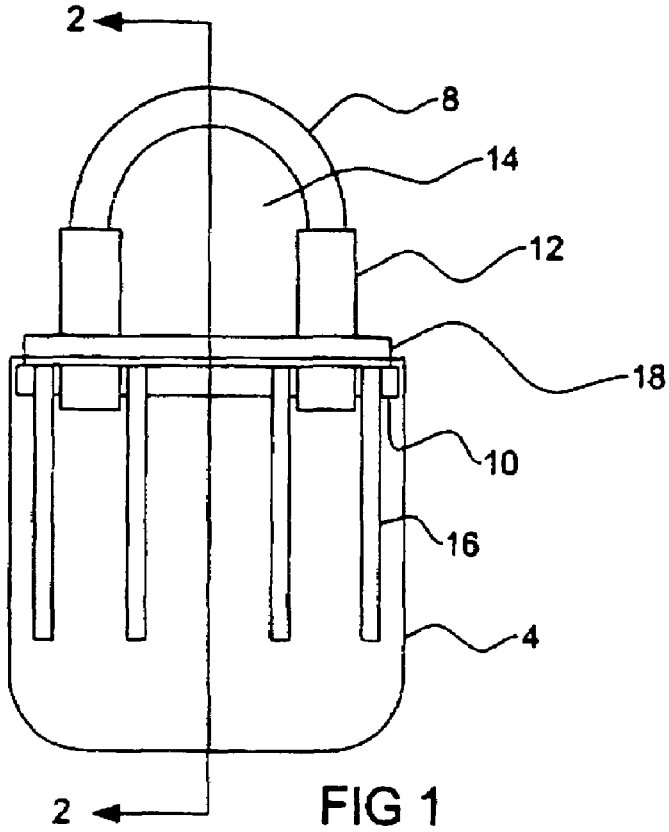
FIG. 1 is a front view of a lifting lug of the present invention in the raised position with the aperture oriented in a vertical plane.
Figure 2:
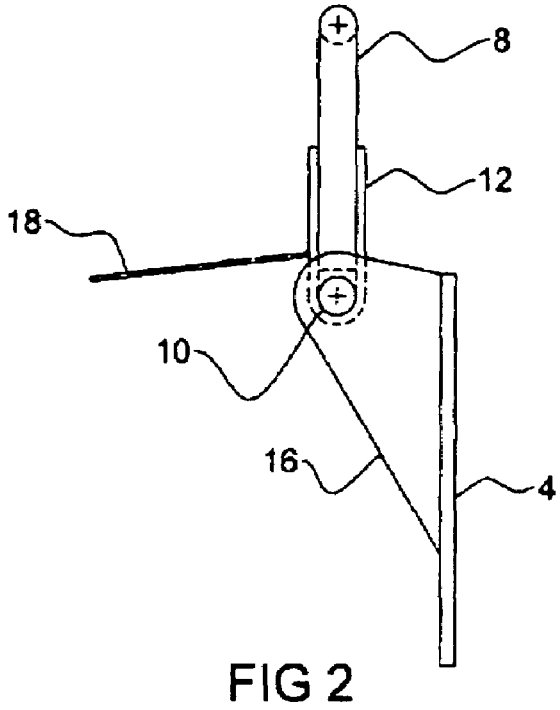
FIG. 2 is a cross-sectional view along line 2-2 in FIG. 1.
Figure 3:
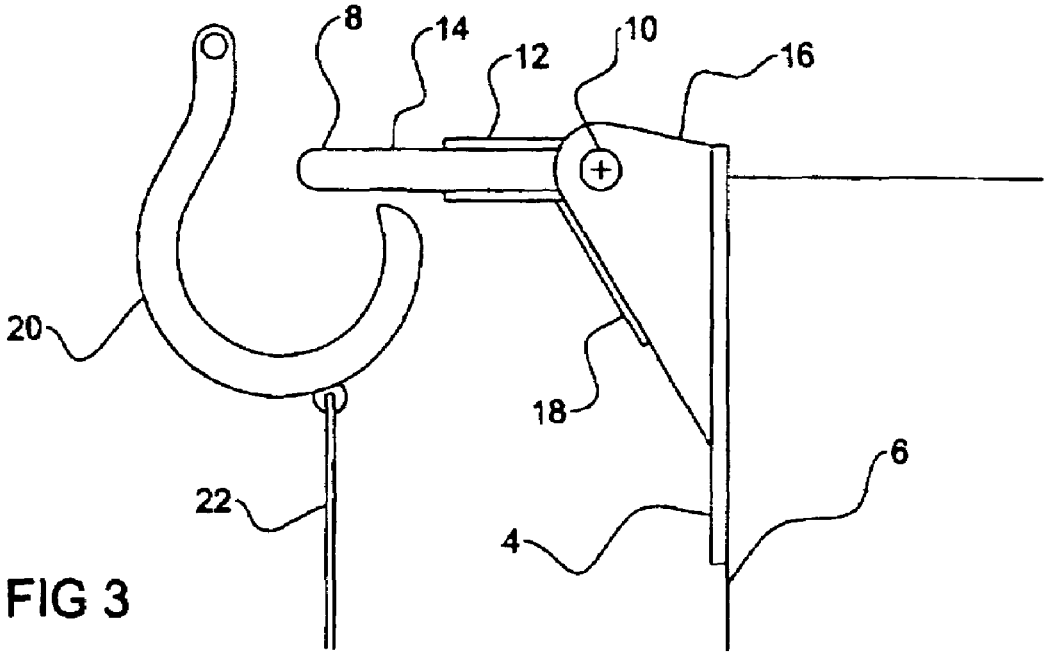
FIG. 3 is a side view of the lifting lug of FIG. 1 in the lowered position fixed to a tank wall with the aperture oriented in a horizontal plane and showing a hook under the aperture thereof.

FIGS. 1-3 illustrate a lifting lug 1 of the present invention. In the illustrated embodiment the lifting lug is shown mounted on a tank such as that used at oil well sites for storage of production fluid, however it is contemplated that the lifting lug could provide benefits when mounted on other large and high objects.

A mounting plate 4 is adapted for attachment to the top of a tank wall 6 by welding or like known means. A rod 8 is bent in a U-shape and is pivotally attached to a substantially horizontal pivot shaft 10 by pivot plates 12 welded to ends of the rod 8. The U-shaped rod 8 thus defines a hook aperture 14. The pivot shaft is attached to the mounting plate 4 by pivot brackets 16.

A counterweight 18 is attached to the pivot plates 12 and extends away from the mounting plate 4 as illustrated. The weight of the counterweight 18 maintains the U-shaped rod 8 in the down position illustrated in FIG. 3, where the hook aperture 14 is oriented in a lateral position in a substantially horizontal plane extending laterally outward from the mounting plate 4 and the tank wall 6. In the illustrated embodiment the counterweight 18 is configured and oriented to bear against the pivot brackets 16 as illustrated in FIG. 3, to support the U-shaped rod 8 so that the hook aperture 14 is oriented in an approximately horizontal plane. Alternatively, a stop could extend from the counterweight 18 and bear against the mounting plate 4, and further alternatively those skilled in the art will readily recognize and implement other means for maintaining the hook aperture 14 in the required approximately horizontal orientation.

A person on the ground can then readily maneuver the hook 20 under the horizontally oriented hook aperture 14 with a tag line 22 attached to the hook 20. Once the person has maneuvered the hook 20 under the hook aperture 14, the person can signal the crane operator to raise the hook 20 and engage the U-shaped rod 8. As the hook 20 moves upward, the U-shaped rod 8 will move from the down position of FIG. 3 to the up position of FIG. 2 and further upward movement of the hook

20 will raise the tank. Thus it is not required to raise a person to the lifting lug in order to engage a hook in the lifting lug to raise a tank.

Figure 4:
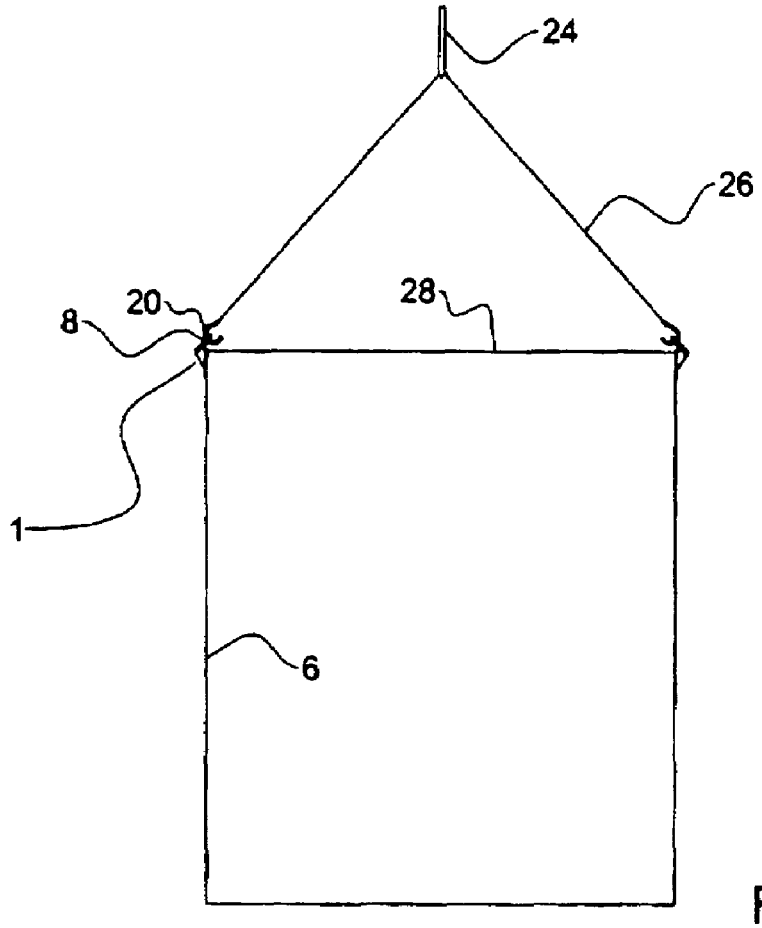
FIG. 4 is a schematic side view of a tank with lifting lugs of the present invention attached at the top end thereof, and showing a main crane cable and secondary cables attaching the lugs to the main cable.

As illustrated in FIG. 4, the lifting lugs 1 of the present invention can be readily mounted spaced around the top of a tank 28 in order to raise the tank 28 without tipping in a manner similar to that of the prior art. FIG. 4 shows a main crane cable 24 and secondary cables 26 extending at an angle from the main cable 24 to lifting lugs 1 spaced around the top of the tank 28. With the pivoting lug 1, the U-shaped rod 8 can move past the vertical position and align itself with the angle of the secondary cable 26 thereby reducing stress on the lug 1 and tank 28.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A lifting lug apparatus comprising:

a mounting plate adapted for attachment to an upper portion of an object to be lifted;

a lifting lug defining a hook aperture, the lifting lug pivotally attached to the mounting plate such that the hook aperture is movable from a lateral position, wherein the hook aperture is oriented in a lateral plane extending laterally outward from the mounting plate and laterally outward from an attached object to be lifted such that a hook can move upward adjacent to the object to be lifted and enter the hook aperture, to an upright position, wherein the hook aperture is oriented in an upright plane extending upward from the mounting plate;

wherein the lifting lug is biased toward the lateral position.

2. The apparatus of claim 1 wherein the lifting lug is biased toward the lateral position by a counterweight attached to the lifting lug.

3. The apparatus of claim 2 wherein the counterweight comprises a plate extending laterally from the lifting lug and configured such that the plate bears against one of the mounting plate and the object to lifted when the lifting lug is in the lateral position.

4. The apparatus of claim 1 wherein the lifting lug is pivotally attached to the mounting plate about a substantially horizontal pivot axis.

5. The apparatus of claim 1 wherein the mounting plate is adapted for attachment to the object to be lifted such that when the lifting lug is in the upright position, the hook aperture is above a top edge of the object to be lifted.

6. A tank apparatus comprising:

a tank comprising a substantially upright wall and a top attached to a top edge of the wall;

a lifting lug defining a hook aperture, the lifting lug pivotally attached to an upper portion of the wall such that the hook aperture is movable from a lateral position, wherein the hook aperture is oriented in a lateral plane extending laterally outward from the wall such that a hook can move upward adjacent to the tank and enter the hook aperture, to an upright position, wherein the hook aperture is oriented in an upright plane extending upward above the top edge of the wall;

wherein the lifting lug is biased toward the lateral position.

7. The apparatus of claim 6 wherein the lifting lug is biased toward the lateral position by a counterweight attached to the lifting lug.

8. The apparatus of claim 7 wherein the counterweight comprises a plate extending laterally from the lifting lug and configured such that the plate bears against the wall when the lifting lug is in the lateral position.

9. The apparatus of claim 6 wherein the lifting lug is pivotally attached to the upper portion of the wall about a substantially horizontal pivot axis.

10. The apparatus of claim 9 wherein the lifting lug is pivotally attached to a mounting plate about the substantially horizontal pivot axis, and the mounting plate is attached to the upper portion of the wall.

* * * * *